US005415355A

United States Patent [19]

Gollwitzer

[11] Patent Number: 5,415,355

[45] Date of Patent: May 16, 1995

[54] METHOD FOR FUNCTIONAL MONITORING OF MECHANICAL PAPER SHREDDERS

[75] Inventor: Rainer Gollwitzer, Gilching, Germany

[73] Assignee: GAO Gesellschaft For Automation Und Organisation MBH, Germany

[21] Appl. No.: 45,601

[22] Filed: Apr. 9, 1993

[30] Foreign Application Priority Data

Apr. 10, 1992 [DE] Germany ..... 42 12 151.5

[51] Int. Cl.[6] ..... B02C 18/40; B02C 18/18; B02C 18/16; B02C 25/00

[52] U.S. Cl. ..... 241/30; 241/36

[58] Field of Search ..... 241/30, 35, 186.2, 36

[56] References Cited

U.S. PATENT DOCUMENTS 4,709,197 11/1987 Goldhammer et al. ..... 241/36 X
4,844,363 7/1989 Garnier et al. ..... 241/35

FOREIGN PATENT DOCUMENTS 0184786 6/1986 European Pat. Off. .
0374481 6/1990 European Pat. Off. .
3412306 10/1985 Germany .

*Primary Examiner*—Douglas D. Watts
*Attorney, Agent, or Firm*—Bacon & Thomas

[57] ABSTRACT

The invention presents an easily carried out method for functional monitoring of mechanical paper shredders. The actual slow-down behavior of the cutter blocks is determined and compared with the slow-down behavior of well-functioning cutter blocks. Deviations in slow-down behavior indicate a functional impairment of the currently utilized cutter blocks. Measures are taken to eliminate the functional impairment in accordance with the degree of deviation.

4 Claims, 2 Drawing Sheets

METHOD FOR FUNCTIONAL MONITORING OF MECHANICAL PAPER SHREDDERS

BACKGROUND OF THE INVENTION

The present invention relates to a method for functional monitoring of mechanical paper shredders in which the sheet material to be destroyed is guided between rotating and meshing cutter blocks.

European print 0 184 786 B1 discloses a mechanical paper shredder for destroying sheet material, in particular bank notes no longer fit for circulation. The bank notes to be destroyed are fed to a cutting unit by means of a transport system. The cutting unit comprises a pair of meshing cutter blocks rotatably mounted in a housing. The cutter blocks have a plurality of cutter disks separated by distance plates. The width of the cutter disks is slightly smaller than that of the distance plates so that the cutter disks of each block protrude into the spaces in the other block without touching it. On the other hand the distance between two meshing cutter disks is clearly smaller than the thickness of the sheet material to be destroyed.

A bank note fed to the cutting unit is cut up in the longitudinal direction by the pair of meshing rotating cutter blocks. Furthermore the bank note is squeezed due to the distances between two meshing cutter disks and cut or torn up in the transverse direction by notches in the cutter disks. Altogether the bank note is cut into small rectangular shreds. Due to the tearing effect in the transverse direction the paper structure is irreversibly destroyed. The combination of such shreds with intent to defraud can thus be excluded.

After the destruction operation the shreds are collected in a vessel. To support the collecting operation the collecting vessel is connected to an air suction system which can produce a directed air stream in the cutting unit. The air stream carries the bank note shreds resulting from the cutting operation into the collecting vessel, churning them and simultaneous cooling the cutting unit. There is thus no danger of a jam being caused by bank note shreds since any shreds sticking to the cutter blocks are carried off by the air stream. Also, the noncontact rotation of the meshing cutter blocks and the cooling produced by the air stream permit continuous operation of the cutting unit.

During operation of such known cutting units it has now been ascertained that soiling arises on the cutter blocks that cannot be eliminated even by a directed air stream. The soiling presumably comes primarily from the bank notes squeezed between the cutter disks during the cutting operation. In the phase in which the bank note strips are torn in the transverse direction they are squeezed between the cutter disks so that the cutting unit no longer works in noncontact fashion. Instead, the bank notes to be cut rub on the cutter disks on both sides, thereby increasing the heat buildup locally in the otherwise frictionless cutting unit and favoring the deposition of greasy and inky paper particles of soiled bank notes. This cannot be prevented by the directed air stream, especially since the effect of the air stream between the cutter disks is negligible during the cutting operation.

Particularly when very soiled bank notes are destroyed, the spaces in the rotating, meshing cutter blocks are loaded in the course of time to such an extent that the function of the paper shredder can be jeopardized. It has been shown that, unless countermeasures are taken, the run of very soiled cutter blocks can result in damage to the drive motor or tearing of the driving belt for the cutter blocks.

SUMMARY OF THE INVENTION

The invention is thus based on the problem of providing an easily carried out method for checking the operativeness of mechanical paper shredders.

The basic idea of the invention is to determine the slow-down behavior of the rotating cutter blocks when no longer driven and to compare the determined values with preset values for clean cutter blocks.

In accordance with the particular idling or slow-down behavior of the cutter blocks to be checked one can thus take the necessary servicing measures in time before critical values are reached and damage occurs.

Control system are known for monitoring the operation of a paper shredder in order to limit the harmful effects of a sudden block of the cutter blocks on the motor and mechanics, e.g. due to a paper jam. A system known from DE-A 34 12 306 can check various working parameters of the motor, such as the power consumption, speed or torque. It disregards a slow power increase (start of the drive) or a slight or slow braking of the motor by the material within the framework of normal deceleration. However, an abrupt, great change in motor speed, caused e.g. by blockage of the cutter blocks, leads to a switch-off of the motor or a decoupling of the motor shaft and the cutter blocks if a critical threshold value is not reached. The control parameters are necessarily monitored in the operating state of the paper shredder since one wants to detect a variation of the parameters in time, caused by the feed of the material to be destroyed. Great relative changes in actual working parameters are evaluated. The cause for slow variations of the parameters in time is irrelevant, as are the absolute values of the parameters.

By contrast, the inventive method is not carried out in the operating state of the paper shredder. The slow-down behavior of the possibly soiled cutter blocks to be checked is determined immediately after the paper shredder is switched off. This slow-down behavior is compared with the slow-down behavior of well-functioning, unsoiled cutter blocks, i.e. the check is performed on absolute values. Comparison of slow-down behavior directly indicates the degree of soiling of the cutter blocks and thus a definite cause for the change in slow-down behavior of the paper shredder being checked. The particular degree of soiling of the cutter blocks is thus directly related to the friction of the cutter blocks. It causes a reduction in the slowing time or a faster drop in the speed of the cutter blocks.

The selection of the measurement phase and the resulting definite marginal conditions ensure that the change in slow-down behavior is caused solely by the increase in soiling in the course of time. The inventive functional test is conducted in the unloaded state of the cutter blocks so that fluctuating, unpredictable parameters existing during operation of the paper shredder definitely do not enter into the functional test. Such unpredictable variations are caused for example by heterogeneous sheet material.

In the inventive method the slow-down behavior (e.g. shortened slowing time) thus indicates the degree of soiling. The only assumption is that the other parameters determining the slow-down behavior of well-functioning, unsoiled cutter blocks (e.g. friction in the bearings) remain constant. Practice has shown that is generally the case. It is thus possible to attribute the change in slow-down behavior to the increased degree of soiling since the degree of soiling is the only variable value in the measurement. In a second step the determined slow-down behavior of the tested cutter blocks is compared to the slow-down behavior of well-functioning cutter blocks.

Any deviations in slow-down behavior are evaluated with reference to preset ranges of tolerance. For example, if the currently determined slowing time has dropped to half the slowing time of a well-functioning paper shredder, this indicates a degree of soiling that makes it necessary to clean the cutter blocks.

This cleaning can be performed by completely replacing the soiled cutter blocks by clean cutter blocks. After replacement the soiled cutter blocks are cleaned (for example in an ultrasonic bath) to be available as a clean cutter block unit for the next replacement. Alternatively, the built-in cutter blocks can of course also be cleaned mechanically, for example by moving a comb-shaped cleaning element in between the unloaded rotating cutter blocks. This has the advantage that the cutter blocks need not be replaced at least for some time.

The increase in soiling is a continuous process, whereby the degree of soiling necessitating cleaning occurs only after some time. This time has been shown to be between a few days and a few weeks. The functional test of the cutter blocks must thus be repeated in a time interval that is clearly smaller than the smallest time shown by experience to elapse before the critical degree of soiling is reached. On the other hand, the measurement of slow-down behavior should not be performed so frequently as to impair the efficiency of the paper shredder built into a sorter, for example, due to excessive idle times. Since the smallest period elapsing before the critical degree of soiling is reached is a few days, it is sufficient to test the actual slow-down behavior and compare it with the slow-down behavior of well-functioning cutter blocks once a day.

This easily performed measure permits a high measure of reliability in the monitoring of operativeness to be reached without reducing the efficiency of the apparatus.

Further advantages of the invention are to be found in the Figures and the corresponding description.

DETAILED DESCRIPTION OF THE PREFERRED EMBODIMENT

Figure 1:
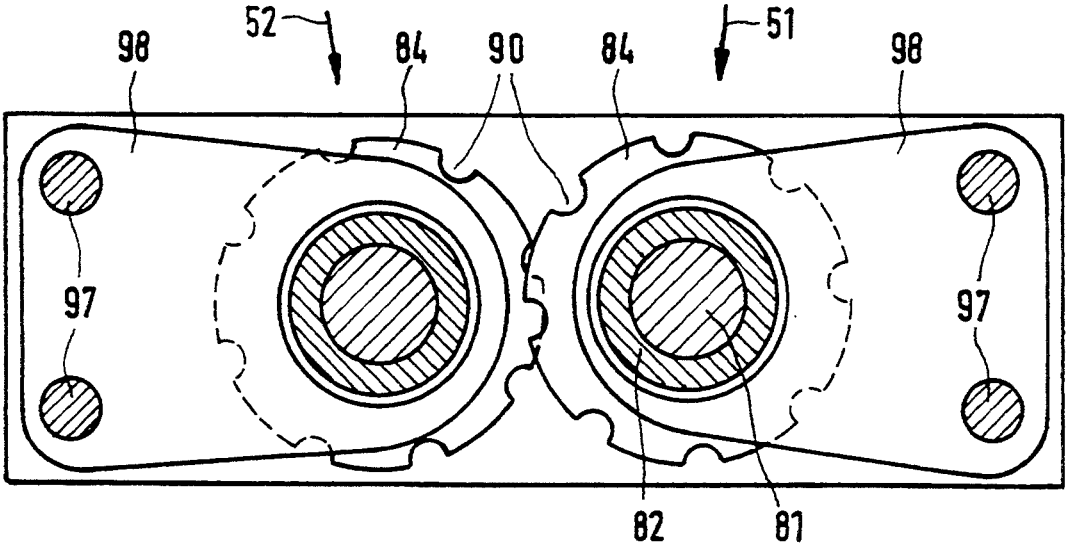
FIG. 1 shows a cutting means.
Figure 2:
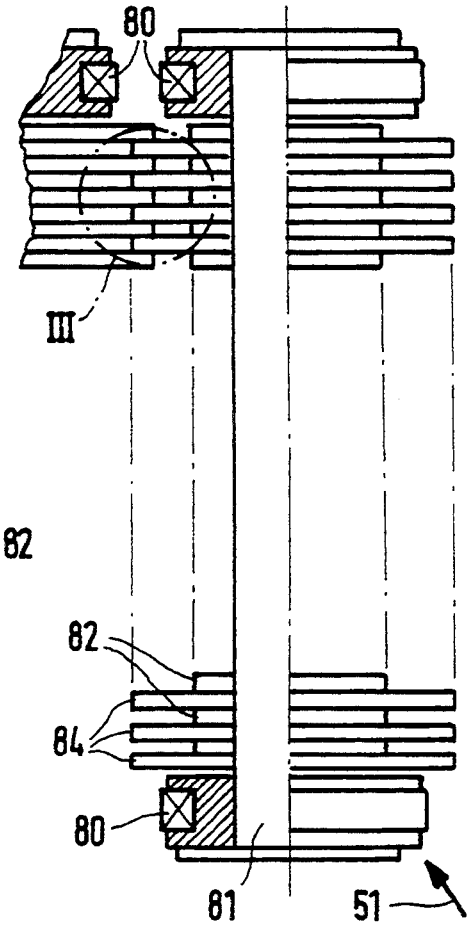
FIG. 2 shows a cutter block in longitudinal section.

FIG. 1 and FIG. 2 show a cutting unit. The cutter blocks each mounted in two bearings 80 comprise a plurality of cutter disks 84 separated by distance plates 82 and disposed on axle shaft 81. The width of cutter disks 84 is slightly smaller than that of the distance plates so that the cutter disks of second block 52 do not touch the cutter disks of first roll 51 when they mesh. On the other hand, the distance between two cooperating cutter blocks is considerably smaller than the customary bank note thickness so as to ensure a reliable squeeze of the bank notes between the cutter disks, a precondition for proper shredding.

As FIG. 1 also indicates, stripping plates 98 are disposed in the gaps between the cutter disks. Stripping plates 98 mounted on arbors 97 are dimensioned and fastened in such a way that they cannot rub either on rotating cutter disks 84 or on distance plates 82. Plates 98 remove any bank note shreds sticking to cutter blocks 51, 52.

Cutter blocks 51, 52 are provided on their circumference with a plurality of sharp-edged notches so that in cooperation with the disks of the second cutter block they also cut or tear the bank notes in the transverse direction.

Figure 3:
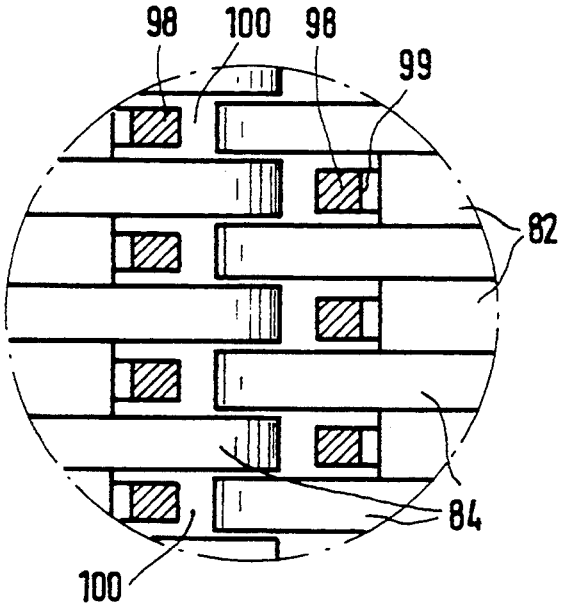
FIG. 3 shows an enlarged detail of FIG. 2.

FIG. 3 shows cutter disks 84 separated by distance plates 82 in an enlarged detail of FIG. 2. During rotation of the meshing cutter blocks, cutter disks 84 do not touch. Stripping plates 98 are located in the space limited by cutter disks 84 and by distance elements 82, without contact to any elements. The greasy and inky particles arising upon contact of the bank notes with cutter blocks 51, 52 and through the tearing operation soil spaces 100 in the rotating and meshing cutter blocks and cannot be eliminated by stripping plates 98 (or by a directed air stream).

The run of the cutter blocks is restrained by the layer of dirt deposited in the course of time. This restraint changes the slow-down behavior of the cutter blocks (shortening the slowing time or decreasing the cutter block speed faster, etc.). The change in slow-down behavior is determined and compared with the slow-down behavior of well-functioning cutter blocks. Cleaning measures are taken in accordance with the result of comparison.

Figure 4:
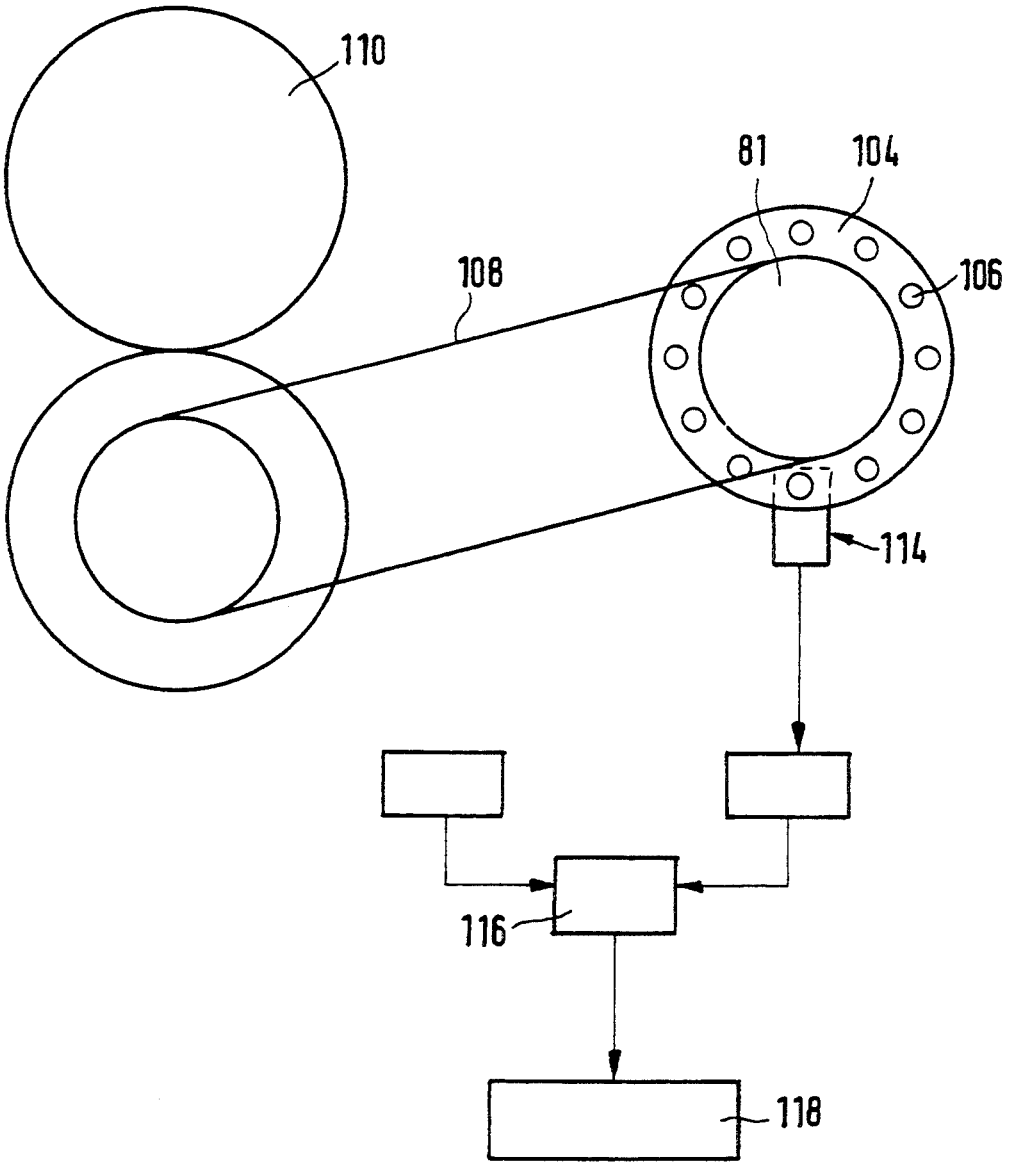
FIG. 4 shows a schematic view of a measuring apparatus.

FIG. 4 shows a schematic view of a measuring apparatus for determining actual slow-down behavior and comparing it with the slow-down behavior of well-functioning cutter blocks.

The measuring apparatus shown determines actual slow-down behavior in particular by exploiting the fact that the actual slowing time of the cutter blocks becomes shorter with increasing friction due to increased soiling after the paper shredder is switched off.

Actual slowing time is easy to measure. Circular disk 104 is fitted on axle shaft 81 such that the centers of axle 81 and disk 104 coincide. Disk 104 is provided with holes 106 at equidistant intervals on a circumference. Axle 81—and thus disk 104 and the cutter block (not shown for simplicity's sake)—are set rotating via toothed belt 108 by motor 110. Belt 108 connects motor axle 112 to cutter block axle 81 with no slip. When the cutter block is too greatly retrained in its run by soiling and the total torque of the motor is transmitted to the belt, belt 108 is overloaded and tears.

When timing disk 104 is set rotating, holes 106 produce pulses in measurement electronics 114 due to a light barrier contained therein. The length of the time interval between pulses is inversely proportional to the speed of disk 104.

Measurement of slowing time begins when measurement electronics 114 receives the first signal. Measurement ends when a predetermined time has elapsed after reception of a signal and no new signal has been received within this time span. The predetermined time is calculable and determined by the duration between two received signals when disk 104 already rotates at a very low angular velocity.

The instantaneous slowing time value obtained for the tested cutter blocks from current measurement is fed to comparator 116. A stored set value for the previously measured slowing time of well-functioning cutter blocks is additionally fed to the comparator. Comparator 116 compares the set value with the instantaneous value, for example by subtraction.

As long as the difference in slowing times does not exceed a critical value stored in the comparator, the cutter blocks are regarded as clean. Otherwise, cleaning of the cutter blocks must be performed. The result of comparison is indicated for example in the form of an instruction "cleaning yes/no" on display 118.

The method described above is performed immediately before or after daily use of the paper shredder so that the shredder can be cleaned if necessary before further use.

Finally, it should be noted that the above measuring method is only by way of example. Instead of measuring the slowing time until the cutter blocks stop, one can thus also determine the time elapsing until the speed drops to a predetermined value. This time becomes shorter due to the friction caused by soiling and should be compared with the corresponding time for well-functioning cutter blocks.

I claim:

1. A method of monitoring the degree of soiling of cutter blocks of a mechanical paper shredder being checked in a non-operating state after power to the shredder is cut off comprising:

determining, in a non-operating state of a reference paper shredder, a reference slow-down behavior associated with clean cutter blocks;

determining a present slow-down behavior of cutter blocks in the paper shredder being checked while the paper shredder being checked is in a non-operating state; and comparing the present and reference slow-down behaviors and evaluating any deviations between the present and reference slow-down behaviors with respect to a predetermined tolerance range, whereby a deviation outside the predetermined tolerance range indicates a functional impairment of the cutter blocks in the paper shredder being checked.

2. The method of claim 1, further comprising periodically performing said monitoring method.

3. A method of monitoring the degree of soiling of cutter blocks of a mechanical paper shredder being checked in a non-operating state after power to the shredder is cut off comprising:

determining an amount of reference time passing between the time a paper shredder with clean cutting blocks is placed in a non-operating state and the time the clean cutting blocks come to a stop;

determining the amount of present time passing between the time the paper shredder being checked with cutter blocks of unknown condition is placed in a non-operating state and the time the cutter blocks of unknown condition come to a stop; and comparing the present time with the reference time and evaluating any deviations between the present time and the reference time with respect to a predetermined tolerance range, whereby a deviation outside the predetermined tolerance range indicates a functional impairment of the cutter blocks in the paper shredder being checked.

4. The method of claim 3, further comprising periodically performing said monitoring method.

* * * * *